US006601430B2

(12) United States Patent
McClellan

(10) Patent No.: US 6,601,430 B2
(45) Date of Patent: Aug. 5, 2003

(54) JACK WITH ELEVATABLE PLATFORM

(75) Inventor: Daniel McClellan, Grand Island, NE (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/973,586

(22) Filed: Oct. 9, 2001

(65) Prior Publication Data

US 2003/0066334 A1 Apr. 10, 2003

(51) Int. Cl.[7] ..... B21D 1/12
(52) U.S. Cl. ..... 72/457; 72/705
(58) Field of Search ..... 72/705, 457; 254/10 R, 254/10 B, 10 C, 122; 187/211

(56) References Cited

U.S. PATENT DOCUMENTS

| | | | | |
|---|---|---|---|---|
| 2,132,343 A | * | 10/1938 | Jarrett | 187/211 |
| 2,557,465 A | * | 6/1951 | Rauscher, Sr. | 254/122 |
| 3,486,583 A | * | 12/1969 | Wiklund | 254/122 |
| 4,986,107 A | | 1/1991 | Peyret | |
| 5,027,639 A | | 7/1991 | Hinson | |
| 5,031,726 A | * | 7/1991 | Wakamiya | 254/122 |
| 5,131,257 A | | 7/1992 | Mingardi | |
| 5,189,899 A | | 3/1993 | Hsu | |
| 5,199,289 A | | 4/1993 | Hinson | |
| 5,263,357 A | | 11/1993 | Dumais | |
| 5,355,711 A | | 10/1994 | Chisum | |
| 5,596,900 A | | 1/1997 | Pietrelli | |
| 5,640,878 A | | 6/1997 | Hinson | |
| 5,918,500 A | | 7/1999 | Brewer, Jr. | |
| 5,931,043 A | | 8/1999 | Liegel et al. | |

FOREIGN PATENT DOCUMENTS

| | | |
|---|---|---|
| BE | 366 902 | 2/1930 |
| CH | 131433 | 2/1929 |
| DE | 2008 788 | 10/1971 |
| DE | 3340883 A1 | 5/1985 |
| FR | 1 109 336 | 1/1956 |

* cited by examiner

*Primary Examiner*—Lowell A. Larson
(74) *Attorney, Agent, or Firm*—Kyle L. Elliott; Blackwell Sanders Peper Martin, LLP

(57) ABSTRACT

A lifting platform with a scissor type jack. The jack includes a plurality of inter-connected struts pivotally connected to a base forming a double X strut arrangement. A power actuator is connected to at least one strut in each X to effect extension and retraction of the jack. A safety latch is provided to prevent accidental retraction of the jack from an extended position should the power actuator fail to hold the jack in the elevated position.

16 Claims, 4 Drawing Sheets

JACK WITH ELEVATABLE PLATFORM

BACKGROUND OF THE INVENTION

The present invention relates to a platform that is selectively elevatable by operation of a scissor-type jack. The jack is extended and retracted by a power actuator.

Scissor jacks for elevating work platforms and objects are well know in the art. One such device is shown in U.S. Pat. No. 5,355,711. This jack is part of a vehicle lift used in chassis straightening. This type of scissor jack utilizes a power actuator 36 attached to a plurality of bars arranged in an X pattern with a pair of bars. Each pair of bars is positioned on a respective opposite side of the work platform. One end of each of the four bars is secured either to the lift platform or to a base frame. One bar in each of the pairs of bars has the actuator connected thereto and the other end of the bar attached to the work platform. The other bar of each pair of bars has one of its ends mounted for movement relative to the floor. The X bar arrangements, through extension of the actuator, will elevate the platform and retraction of the actuator lowers the platform. Such an arrangement of bars results in the pivot point 27 between the two bars in each pair moving laterally during extension and retraction which also moves the center of the support provided for by the jack under the platform. Another problem with the type of jack shown in U.S. Pat. No. 5,355,711 is that the arrangement of bars and power actuator limit how low the platform can be lowered.

Another type of scissor jack is made by Southworth and available as Model No. A-350W. This scissor jack is a double X arrangement with one X stacked on top of the other, i.e. in the direction of extension for lifting and retraction for lowering. A similar jack is available from Dayton and can be found in the Grainger Catalog #391 as Stock No. 3KR47. In this latter jack, the center between the support points with the platform also moves laterally with elevation of the platform.

Another type of scissor jack is operated by a screw and a manually operated crank handle and is available typically as an automobile jack used for changing tires. This type of jack uses a base, a car engaging top platform and four bars on each side of the jack, two lower bars on each side being connected to the base (forming an upwardly diverging V), two upper bars on each side being connected to the work platform (forming a downwardly diverging V). Further, the upper and lower two bars on each side are pivotally connected to one another. In this type of jack, the center of support does not move laterally during extension and retraction of the jack.

Thus, there is a need for an improved elevatable platform utilizing a scissor-type jack in which the center of the jack moves along a path generally parallel to the direction of movement of the load engaging platform and that provides a low profile when retracted.

SUMMARY

The present invention involves the provision of a jack device adapted for use to apply a force or support a load and move the load between a lowered position and an elevated position. The device includes an improved scissor jack that when in its lowered or retracted position will provide a compact profile in height. The jack has an arrangement of bars that maintains a center of movement along a common center line that is generally parallel to the direction of extension of the jack. The jack utilizes a double X arrangement of bars which arrangement has a longitudinal axis generally transverse to the direction of extension of the jack in the load applying direction. Free ends of the bars forming the two X's contact either a base or the load engaging platform for supporting the platform above the base. The other ends of the bars are mounted for pivotal movement either to the base or to one another. The bars forming each X are pivotally connected to one another. The free ends of the bars in each X may be provided with rollers to reduce friction during extending and retracting movement of the jack. A power actuator is connected between the two X's and is operable to expand and contract the double X arrangement to extend and retract the platform. A safety latch can be provided to ensure that the jack remains at a desired extended position in the event the power actuator should fail. The safety latch may be operated remotely by the actuation of another power actuator. The platform may be a relatively large platform utilizing a plurality of the jacks, say for example four. Such an arrangement would be particularly useful for an automotive straightening bench.

IN THE DRAWINGS

Like numbers throughout the drawings designate like or similar parts.

DETAILED DESCRIPTION

Figure 1:
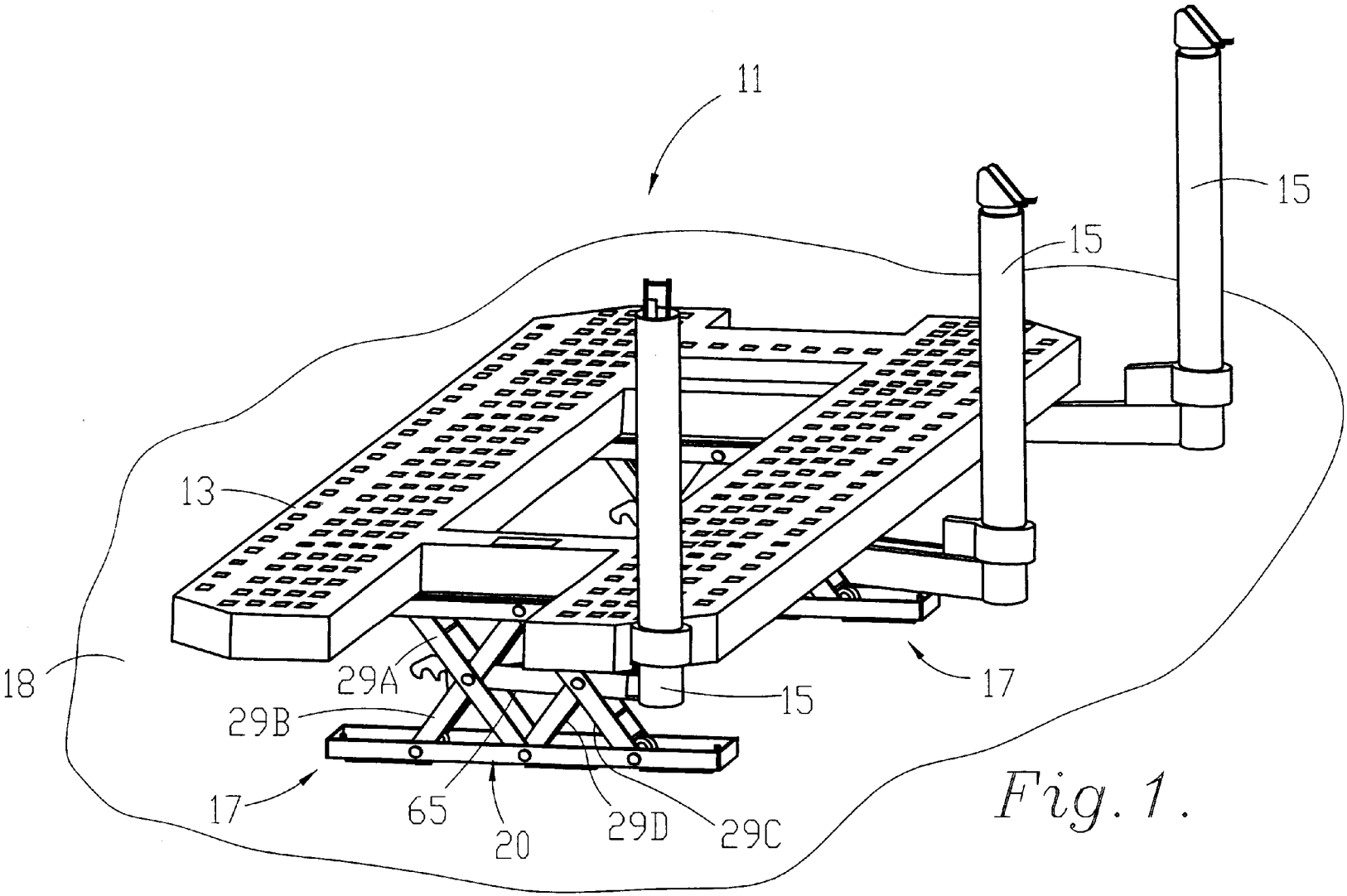
FIG. 1 is a perspective view of an automotive chassis straightening bench with sections broken away to show the locations of elevating jacks.

The reference numeral 11 designates generally an automotive chassis straightening bench. Straightening bench 11 includes a work platform 13 on which a chassis (not shown) may be positioned and secured for performing chassis straightening or other body work. The bench 11 includes one or more pulling towers 15 which are used to apply a straightening force to the chassis. Such benches are well known in the art. An example of such a bench is Model S21 available from Chief Automotive of Grand Island, Nebr. Generally, the platform 13 is in a lowered position and the chassis is pulled or driven onto the platform and is secured in place as is known in the art. To facilitate the body work, the platform 13 is moved to an elevated position as seen in FIG. 1 to provide more convenient access to the chassis by a worker. While a straightening bench has been illustrated, the below described jack can be utilized with other types of work benches or may be simply used as a free standing jack to apply force to an object, typically, a lifting force. Further, force may be applied in directions other than vertical utilizing the below described jack. The jack 17 is described herein as it is oriented in an upstanding position to extend and retract in a generally vertical direction as seen in FIG. 1. In the illustrated embodiment of straightening bench, two jacks 17 are positioned between the floor 18 or other support surface and the platform 13 to selectively move the platform between a lowered position and an elevated position. The jacks 17 extend generally transverse to the longitudinal axis of the platform 13. However, the jacks 17 may be oriented generally parallel to the longitudinal axis of the platform 13. Their positions are selected to provide stability for the platform 13.

Figure 2:
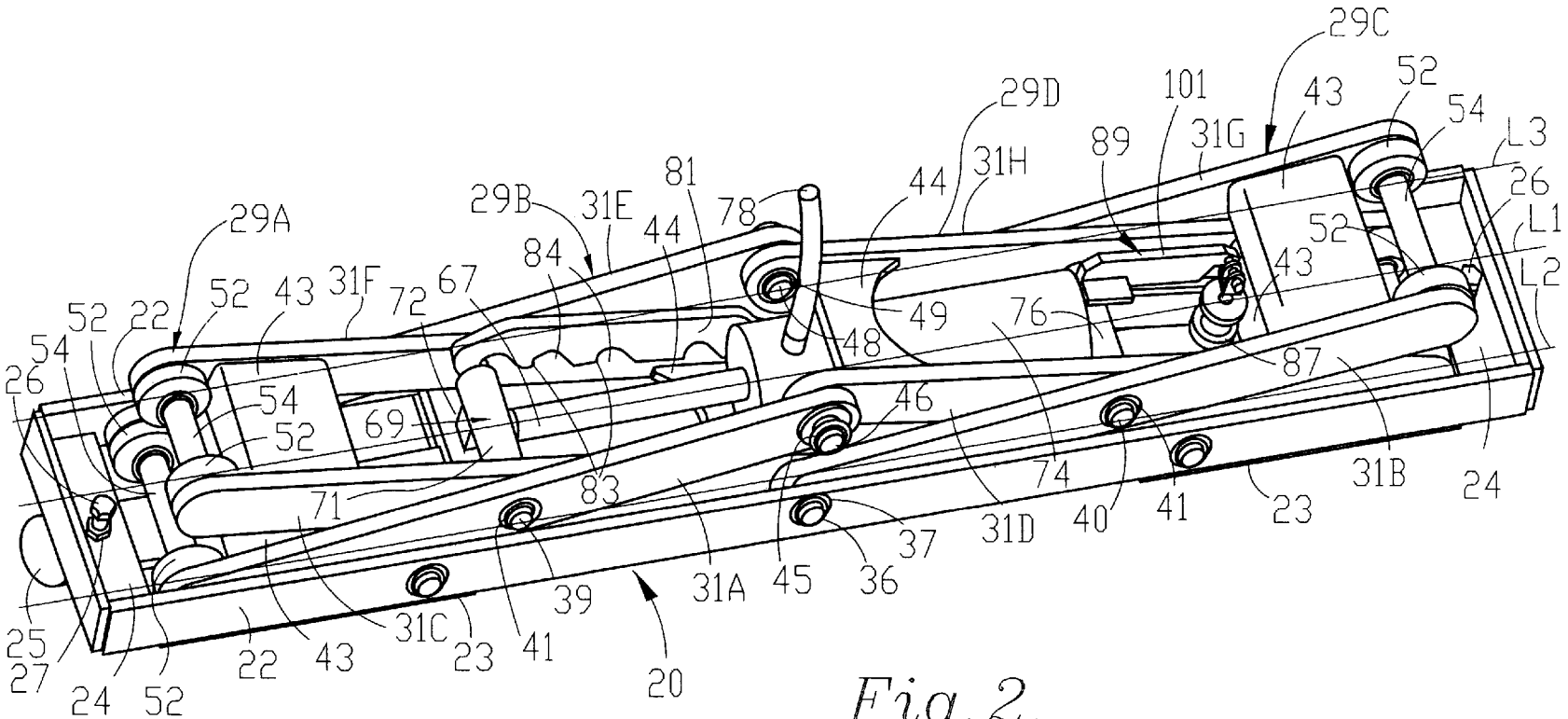
FIG. 2 is an enlarged perspective view of a jack shown in its lowered position.
Figure 3:
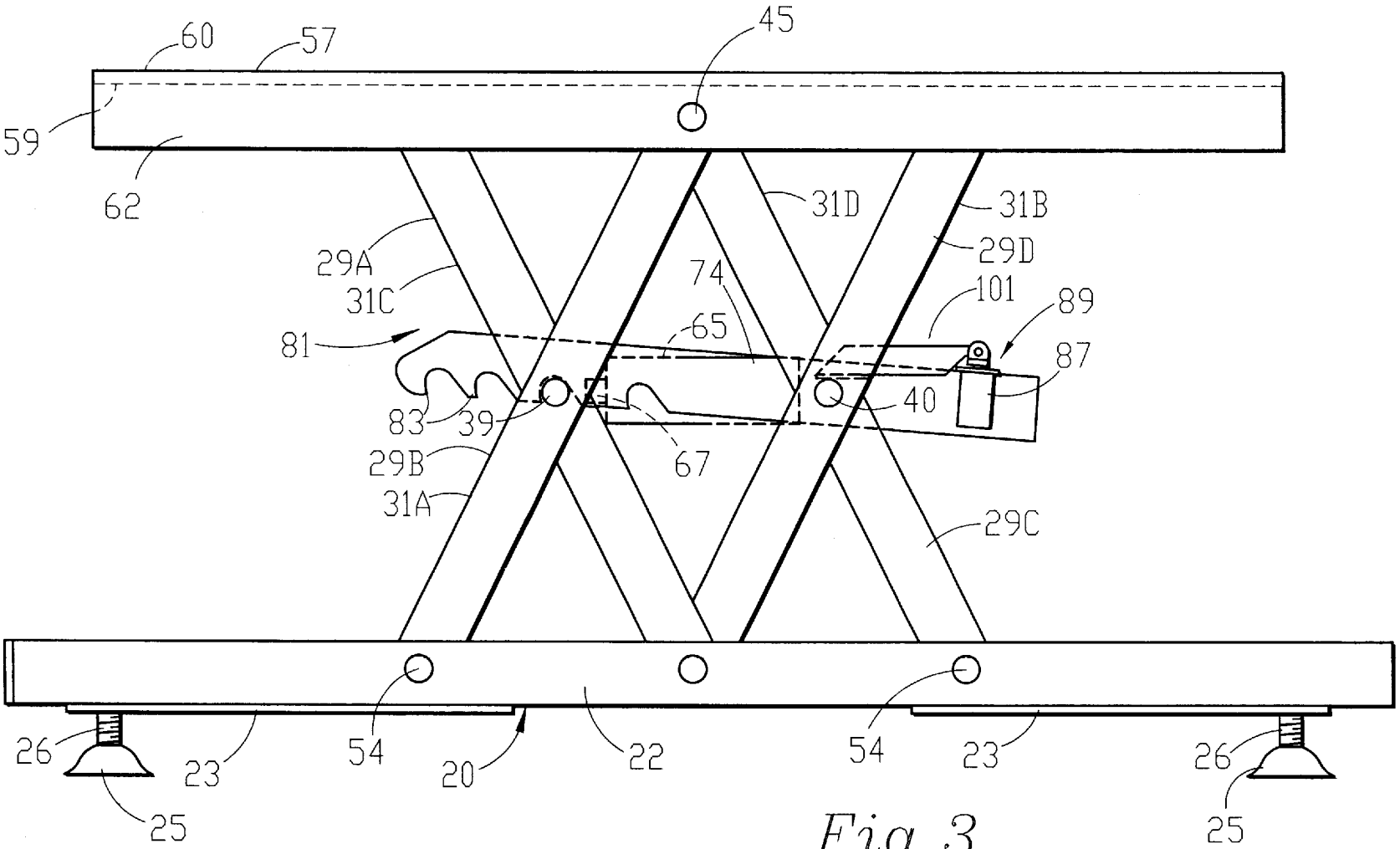
FIG. 3 is a side elevation view of the jack in an elevated position.

As seen in FIGS. 2 and 3, a jack 17 is comprised of a base 20 having side upstanding flanges 22 with support plates 23 secured to and extending between flanges 22 for a purpose later described. Cross braces 24 are secured to and extend between the flanges 22 adjacent their opposite ends. In one embodiment of the present invention, adjustable foot pads 25 (FIG. 3) are mounted on and project from under the support plates 23 of the base 20 to engage the floor 18 providing a leveling adjustment for the jack 17 via threaded bolts 26. Once adjusted, lock nuts 27 can be tightened to prevent the bolts from becoming loose and allowing the base 20 to move from its desired orientation. The flanges 22 rigidify or brace the base 20 against bending when the pads 25 elevate it above the floor. The base 20 is elongate having a longitudinal axis designated L1, FIG. 2. The jacks 17 may be secured either to the bench 11 or to the floor 18 or both to help resist moving relative to the floor 18 during operation of the bench 11, e.g., when the platform is being loaded with the chassis, etc.

As seen in FIGS. 2 and 3, the jack 17 includes a plurality of struts, designated 29A–D pivoted to the base 20 and/or to one another in an arrangement to move between the retracted or lowered position as seen in FIG. 2 and the extended or elevated position as seen in FIG. 3. In the illustrated embodiment, the struts 29A–D each includes two bars 31A–G that are positioned adjacent each of the flanges 22. Strut 29A includes bars 31C, F, strut 29B includes bars 31A, E, strut 29C includes bars 31B, G and strut 29D includes bars 31D, H. Preferably the bars 31 are generally parallel to a vertical plane thru the longitudinal axis L1 and to one another. The struts 29A–D form a four bar linkage arrangement by their interconnections. Although four struts, each comprising two bars, total are used in the illustrated embodiment, four bars being on each side and forming two laterally spaced double X arrangements, it is to be understood that an alternate embodiment could utilize four bars to form the four struts. Further, more than four struts and eight bars could be utilized in the expandable/retractable section of the jack 17. In the illustrated embodiment, the bars 31 on either side of the jack 17 form an interconnected double X arrangement of bars.

Each of the double X arrangements of the struts 29 and bars 31 is shown as including two struts, four bars each. The bars are designated 31A–H for distinction. Bars 31A–D form one double X arrangement and the bars 31E–H forming a second double X arrangement each being substantially in a plane generally parallel to one another and to the vertical plane thru the axis L1. Two of the bars in each of the double X arrangements are pivotally mounted adjacent free ends thereof to the base 20 forming an upwardly opening V. As shown, the bars 31B, C, F and G are pivotally mounted about an axle 36 mounted generally centrally along the length of the base 20 and the braces 22. Keepers 37 secure the axle 36 in place on the base 20. Thus, the bars 31B, C, F, and G pivot about a common axis. The bars 31A, B, E and G are outboard of the respective bars 31C, D, F and H which allows the two double X arrangements to contract without interference therebetween, during retraction of the jack 17. The bars 31A and C are pivotally mounted to one another and the bars 31B and D are pivotally mounted to one another, the bars 31E and F are pivotally mounted to one another and the bars 31G and H are pivotally mounted to one another. The pivotal mounting of the bars to one another is about midway and preferably at about the centerpoint between their opposite ends and is accomplished via axles 39 and 40 which extend between the two sets of double X's and are retained in place by suitable keepers 41. The spacing is maintained between the two sets of double X's by having braces 43 secured to and extending between the bars 31 preferably adjacent their free ends. Cross braces 44 are secured to and extend between the bars 31D and 31H and the bars 31C and 31F adjacent the axles 46, 48 and axle 36 respectively. Because the braces 44 are between inboard bars 31, they also maintain the outboard bars spaced apart. The bars 31A and D are pivotally connected together adjacent free ends thereof with the axle 46 retained in place by keepers 45. A strut 29 is thus comprised of two bars 31 and respective brace 43 or 44 in the illustrated embodiment. As described, an alternate embodiment uses a bar 31 on only one side of the jack, e.g. bars 31A–D in which event the bars 31A–D would be the struts 29. Likewise, the bars 31E and H are pivotally connected together adjacent free ends by an axle 48 retained in place by keepers 49. The pairs of bars 31A, 31D and 31E, 31H form downwardly opening V's opening toward the base. The axles 46 and 48 are axially aligned providing a common pivot axis for the connected bars. The axis of pivoting for the bars 31A, D, E and H is generally parallel to the base and moves in a line generally perpendicular to the bottom of the base 20 during expansion and retraction. All of the bars 31A–H each have a free end. The free ends of the pairs of bars 31A, D, E and H have friction reducing elements mounted thereon to engage the plates 23 during extension and retraction of the jack 17. In a preferred embodiment, the friction reducing elements are rollers 52 rotatably mounted on axles 54. The rollers 52 may include ball or roller bearings to also help reduce friction. The axles 54 are mounted on and extend between respective bars 31. During extension of the jack 17, the rollers 52 move toward the center of the base 20 and during retraction of the jack, the rollers move toward the outer ends of the base 20. The flanges 22 help guide the movement of the bars 31 during extension and retraction of the jack bracing them against lateral movement. The free ends of the bars 31B, C, F and G move upwardly during an extension of the jack and can also have provided on their free ends rollers 52 on axles 54. During extension of the jack 17, the free ends of the bars 31B, C, F and G move upwardly and inwardly toward the axles 46, 48. A track 57 is mounted on the axles 46, 48 and moves upwardly during extension of the jack 17 and downwardly during retraction of the jack. The rollers 52 on the arms 31B, C, F and G engage an inner disposed surface 59 of a web 60 of the track 57 and prevent the track 57 from pivoting on the axles 46, 48. The track 57 includes two side walls 62 projecting from the web 60 toward the base 20. The track 57 may be secured to the platform 13 or may be held in place by the weight of the platform thereon. When the jack is used alone, the track 57 functions as a load applying platform. The two double X bar arrangements each have a respective longitudinal axis L2, L3 which are both generally parallel to the base 20 and the track 57 with the axes L2 and L3 passing through the axles 46, 48. The axes L2 and L3 are also generally parallel to the longitudinal axis L1 of the base 20, in the retracted and extended positions of the jack 17 and preferably throughout movement between the retracted and extended positions.

A power actuator is provided to effect extension and retraction of the jack 17. As seen in FIG. 2, the power actuator includes a linear actuator such as a fluid cylinder 65 (FIG. 3) that has a longitudinal axis in a plane generally parallel to the longitudinal axes L1, L2 and L3. This allows for a compact structure (low profile) for the jack 17 when retracted. As shown, the cylinder 65 is a piston cylinder with an extendable and retractable rod 67 pivotally mounted on the axle 40. As shown, the pivotal mounting is via a clevis style mount arrangement designated generally 69. A sleeve 71 is mounted on the axle 39 for rotation thereon and includes a bracket 72 to which the clevis is pivotally mounted. Alternately, the rod 67 may be connected directly to the sleeve 71. The cylinder 65 includes a piston housing 74 that is pivotally connected to the axle 40. In the illustrated embodiment, the connection of the housing 74 to the axle 40 is via a sleeve 76 secured to the base end of the housing 74 through which the axle 40 extends. Upon contraction of the cylinder 65, effected by the flow of pressurized fluid such as hydraulic fluid through a conduit 78 from a pump 79 (FIG. 4), the axles 39, 40 move toward one another to effect extension of the jack 17 and separation of the base 20 from the track 57 to apply force to the 15 platform for elevating the same. Upon release of the pressurized hydraulic fluid from the cylinder 65, the cylinder 65 extends allowing the jack 17 to move to its retracted condition. The cylinder 65 may be of the single acting type with a spring return to help induce the cylinder 65 to move to its extended position. If desired, fluid is stored in the opposite side of the cylinder housing. Preferably, the hydraulic system utilizes gravity for increased efficiency. Thus, the reservoir is positioned above the cylinders. Rate of control of extension of the cylinder 65 may be effected by a flow control valve 65V, FIG. 4, which will regulate the flow of hydraulic fluid out of the cylinder 65 while operation of the cylinder to extend and retract is controlled by valve 80. To enhance safety, the towers 15 cannot pull unless the flow control valve 65V is closed.

Figure 4:
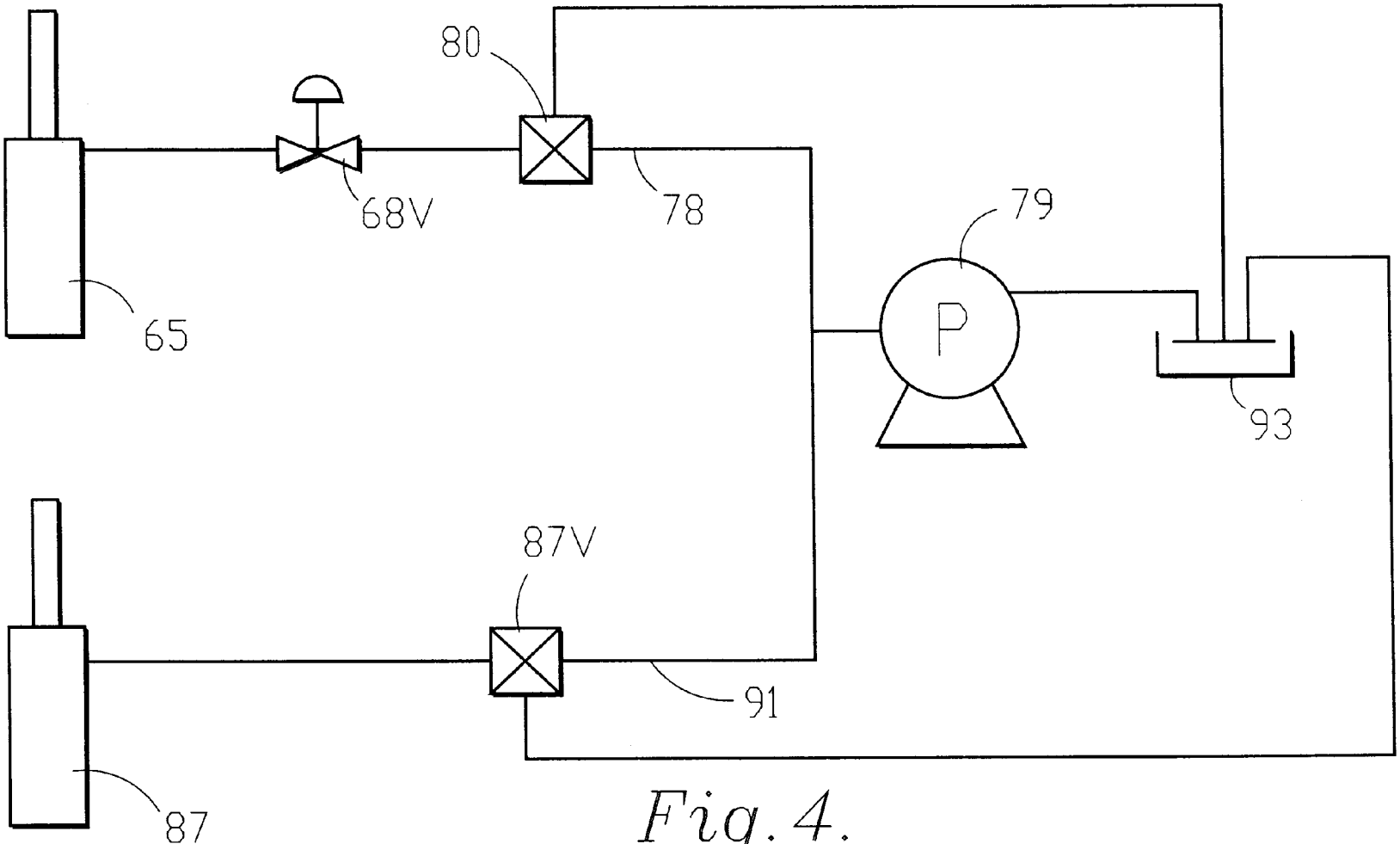
FIG. 4 is a schematic of a simplified hydraulic circuit.

The jack 17 may also be provided, and preferably is, with a safety latch which will ensure that the jack 17 stays in an extended position to prevent accidental retraction. As shown, the safety latch includes a latch member 81 pivotally mounted on the jack, for example, on the axle 40. The latch 81 includes a plurality of hooks 83 defined by notches 84. The latch 81 is biased to a latching position to ensure that the hooks 83 will catch to prevent retraction. In the illustrated embodiment, the latch 81 cooperates with the axle 39. The hooks 83 are selectively engageable with the axle 39 to effect latching of the latch 81. It is preferred that the biasing be by a remotely activated actuator to eliminate the need for a worker to be close to the platform or perhaps even under the platform to disengage the latch 81 so that the platform may be lowered. A power actuator such as an air or hydraulic cylinder 87 can be used. One end of the cylinder 87 is connected via a clevis mount arrangement 89 to a free end of the latch 81 via a bracket 101. The other end of the cylinder 87 may be mounted in any suitable manner. The cylinder 87 may be spring biased or pressurized to place the latch in its latching position which in the structure shown in FIG. 2 would be a counter clockwise rotation about the axle 40. To release the latch 81 from the latching position, the cylinder 87 would be extended under control of valve 87V to pivot the latch member 81 clockwise to prevent engagement between the hooks 83 and axle 39. As seen in FIG. 4, the cylinder 87 is connected to the pump 79 via conduit 91, the valves 80, 87V and pump 90 are all connected to the fluid storage tank 93.

The jack of the present invention may be utilized alone as a jack or as one of the jacks in a chassis straightening bench. It may also be used alone to elevate a small work platform or may be used simply to temporarily elevate an object. It is shown in the drawings that the jack extends and retracts in a generally vertical direction. However, the jack may be used to apply force in other directions as for example horizontal or at other angles. Further, the jack is shown as utilizing a side-by-side double X arrangement for the struts 29 and bars 31 but it is to be understood that the free ends of the bars 31 and hence struts 29 on one end of the jack may be dispensed with providing a single X plus V version. In such an embodiment, for example, the free ends on the right hand end of the jack as shown in FIG. 2 may be eliminated. This would provide a jack with a single X plus a sideways V set of bars and struts. In this latter version the ends of the bars adjacent the axle 45 and 48 may be used to support the load in addition to the free ends of the remaining bars 31.

The invention has been described in conjunction with specific embodiments thereof. However, many alternatives, modifications and variations will be apparent to those ordinarily skilled in the art. Accordingly, the invention is intended to embrace all such alternatives, modifications and variations that fall within the spirit and scope of the appended claims.

What is claimed is:

1. A vehicle chassis straightening bench including a lift selectively movable between a lowered position and at least one elevated position, said lift including:

a platform having an upwardly facing surface adapted to support a vehicle to be elevated;

at least one jack positioned under the platform, said jack being operable to selectively elevate said platform and includes a base with a first set of struts pivotally mounted on said base operable to move between first and second positions, said struts of the first set each have first and second ends with the first ends being movable toward and away from one another during raising and lowering, respectively, of the jack, said first set of struts are oriented to form a generally V-shaped arrangement diverging away from the base, a power actuator operably connected to the first set of struts for selectively moving the first set of struts between a platform lowered position and a platform elevated position, said jack further including at least one second set of struts, said second set of struts being oriented to form a generally V-shaped arrangement diverging toward the base, each strut of the second set being pivotally connected to a respective strut of the first set with at least one strut of the first set being pivotally connected to a strut of the second set intermediate opposite ends of both said first and second struts with one of said opposite ends of each of said intermediate pivotally connected first and second struts being a free end with at least one free end being operable to apply a downwardly directly force to support the platform when elevated and another free end being operable to apply an upwardly directed force to support the platform when elevated.

2. A bench as set forth in claim 1 wherein the pivotally connected struts of the first and second sets form an X arrangement.

3. A bench as set forth in claim 2 wherein the first and second sets of struts each include at least two struts and form double X arrangements of bars with the X arrangements being in end-to-end relation, said first set of struts providing at least two free ends each to apply an upwardly directed force to support the platform when elevated and the second set of struts providing at least two free ends each to apply a downwardly directed force to support the platform when elevated.

4. A bench as set forth in claim 3 wherein axles pivotally connect the first and second sets of struts together and said actuator is operably connected to at least two said axles whereby retraction of the actuator elevates the platform and extension of the actuator lowers the platform.

5. A bench as set forth in claim 3 wherein there is a centerpoint between said pivotal connections of the first and second sets of struts to one another and said center point moves along a line generally parallel to the path of movement of the platform during elevating and lowering of the platform.

6. A scissor jack comprising:

a base with a longitudinal axis;

a plurality of struts connected together and to the base, said struts forming an arrangement of at least two end-to-end X's with a longitudinal axis generally parallel to the longitudinal axis of the base, certain of said struts being movable relative to one another whereby said X's will expand longitudinally and contract transverse thereto and will contract longitudinally and expand transverse thereto to apply a force in the transverse direction; and a power actuator, horizontally positioned and operably connected to selected struts to effect the extension in the transverse direction by applying force in the same longitudinal direction as the base.

7. A scissor jack as set forth in claim 6 wherein said longitudinal axes are generally horizontal.

8. A scissor jack as set forth in claim 7 wherein certain of the struts have free ends at open ends of the X's, said jack including a lift member and a rotatable member mounted on each of the strut free ends, said rotatable members each engaging either the base or lift member and wherein longitudinal contraction of the X's effects movement of the base and lift member apart from one another.

9. A scissor jack as set forth in claim 6 wherein there are two X strut arrangements, one of the struts included in one X is pivotally connected at its end opposite its free end to the base and one of the struts included in the other X is pivotally connected to the base at its end opposite its free end.

10. A scissor jack as set forth in claim 9 wherein the struts ends pivotally connected to the base have a common pivot axis.

11. A scissor jack as set forth in claim 10 wherein the other struts of the X's not pivotally connected to the base have their other ends pivotally connected at a common pivot axis forming a four bar linkage arrangement.

12. A scissor jack arrangement as set forth in claim 11 wherein the X strut arrangements each include two struts pivotally connected together intermediate their opposite ends to form the respective X, and wherein the power actuator includes a linear actuator connected between the X strut arrangements.

13. A scissor jack as set forth in claim 12 wherein the linear actuator includes a piston cylinder.

14. A scissorjack comprising:

a base with a longitudinal axis;

a plurality of struts connected together and to the base, said struts forming an arrangement of at least two end-to-end X's with a longitudinal axis generally parallel to the longitudinal axis of the base, certain of said struts being movable relative to one another whereby said X's will expand longitudinally and contract transverse thereto and will contract longitudinally and expand transverse thereto to apply a force in the transverse direction; and a power actuator, extending horizontally between pivot points of the end-to-end X's and operably connected to the pivot points of the end-to-end X's to effect the extension in the transverse direction by applying force in the same longitudinal direction as the base.

15. A scissor jack comprising:

a base with a longitudinal axis;

a plurality of struts connected together and to the base, said struts forming an arrangement of at least two end-to-end X's with a longitudinal axis generally parallel to the longitudinal axis of the base, certain of said struts being movable relative to one another whereby said X's will expand longitudinally and contract transverse thereto and will contract longitudinally and expand transverse thereto to apply a force in the transverse direction; and a power actuator, extending horizontally between two moveable pivot points of the end-to-end X's to effect the extension in the transverse direction by applying force in the same longitudinal direction as the base.

16. A vehicle chassis straightening bench including a lift selectively movable between a lowered position and at least one elevated position, said lift including:

a platform having an upwardly facing surface adapted to support a vehicle to be elevated;

at least one jack positioned under the platform, said jack being operable to selectively elevate said platform and includes a base with a first set of struts pivotally mounted on said base operable to move between first and second positions, said struts of the first set each have first and second ends with the first ends being movable toward and away from one another during raising and lowering, respectively, of the jack, said first set of struts are oriented to form a generally V-shaped arrangement diverging away from the base;

at least one second set of struts, said second set of struts being oriented to form a generally V-shaped arrangement diverging toward the base, each strut of the second set being pivotally connected to a respective strut of the first set to form a double X arrangement of bars with the X arrangements being in end-to-end relation, said first set of struts providing at least two ends each to apply an upwardly directed force to support the platform when elevated and the second set of struts providing at least two free ends each to apply a downwardly directed force to support the platform when elevated;

axles which pivotally connect the first and second set of struts together; and a power actuator operably connected to at least two said axles, whereby retraction of the actuator elevates the platform and extension of the actuator lowers the platform.

* * * * *